US005147022A

United States Patent [19]

Raschka

[11] Patent Number: 5,147,022

[45] Date of Patent: Sep. 15, 1992

[54] APPARATUS FOR MERGING MASS FLOWS OF ROD-SHAPED ARTICLES OF THE TOBACCO PROCESSING INDUSTRY

[75] Inventor: Wolfgang Raschka, Hamburg, Fed. Rep. of Germany

[73] Assignee: Körber AG, Hamburg, Fed. Rep. of Germany

[21] Appl. No.: 695,977

[22] Filed: May 6, 1991

[30] Foreign Application Priority Data

May 8, 1990 [DE] Fed. Rep. of Germany ..... 4014713

[51] Int. Cl.[5] ..... B65G 37/00

[52] U.S. Cl. ..... 198/347.2; 198/357; 198/368

[58] Field of Search ..... 198/347.2, 347.3, 357, 198/368

[56] References Cited

U.S. PATENT DOCUMENTS

| | | | |
|---|---|---|---|
| 3,952,854 | 4/1976 | Selonke et al. | 198/347.3 |
| 4,364,462 | 12/1982 | Tolasch et al. | 198/347.3 |
| 4,365,702 | 12/1982 | Tolasch et al. | 198/347.3 |
| 4,507,040 | 3/1985 | Baese et al. | 198/347.2 X |
| 4,865,179 | 9/1989 | Carter et al. | 198/347.2 |
| 4,986,408 | 1/1991 | Carter et al. | 198/368 |

FOREIGN PATENT DOCUMENTS 1923500 11/1969 Fed. Rep. of Germany ..... 198/368

*Primary Examiner*—Robert P. Olszewski
*Assistant Examiner*—Cheryl Li Gastineau
*Attorney, Agent, or Firm*—Peter K. Kontler

[57] ABSTRACT

A first mass flow of rod-shaped articles of the tobacco processing industry is transported along a substantially horizontal path wherein the articles are moved sideways, and a second mass flow of articles is transported along an upwardly or downwardly sloping path which makes with the horizontal path an acute angle and merges into the horizontal path at a junction zone wherein the flow of articles is controlled by a pivotable gate. The gate has a blocking surface which intercepts the articles of the mass flow in the first or second path when the gate is moved to a first position, and at least one guide surface which controls the flow of articles in the first or second mass flow during advancement through the junction zone in the first position of the gate. The gate can be pivoted by a second position in which its blocking surface does not interfere with advancement of articles of both mass flows into, through and beyond the junction zone. The gate can be provided with a second guide surface which defines with the blocking surface and an adjacent wall a first-in last-out reservoir for surplus articles in the second position of the gate.

15 Claims, 2 Drawing Sheets

APPARATUS FOR MERGING MASS FLOWS OF ROD-SHAPED ARTICLES OF THE TOBACCO PROCESSING INDUSTRY

BACKGROUND OF THE INVENTION

The invention relates to improvements in apparatus for manipulating mass flows or streams of rod-shaped articles of the tobacco processing industry. More particularly, the invention relates to improvements in apparatus for merging mass flows of plain or filter cigarettes, filter rod sections, cigarillos, cigars, cheroots or other rod-shaped articles of the tobacco processing industry. Still more particularly, the invention relates to improvements in apparatus for merging mass flows consisting of parallel rod-shaped articles which are transported sideways, i.e., at right angles to their respective longitudinal axes.

Apparatus for merging mass flows of rod-shaped articles are used in certain production lines for cigarettes, filter rod sections and other rod-shaped articles of the tobacco processing industry. Hereinafter, such articles will be referred to as cigarettes with the understanding, however, that the apparatus can be used with equal advantage for merging mass flows of other rod-shaped articles of the tobacco processing industry. For example, mass flow merging apparatus can be used to unite the outputs of two or more producing machines on the way to a lesser number of processing machines or to storage, or from two or more magazines to a lesser number of processing machines, such as packing machines or filter tipping machines. Furthermore, mass flow merging apparatus can be put to use in production lines which are composed of or contain large numbers of producing and processing machines, for example, to merge the outputs of two or more producing machines if one or more processing machines happen to be out of commission but it is desirable not to arrest the producing machines. Under such circumstances, the producing machines will be operated at less than their nominal speed.

Machines which employ apparatus for merging mass flows of cigarettes or the like are described and shown, for example, in commonly owned U.S. Pat. Nos 4,364,462 (granted Dec. 21, 1982 to Tolasch et al.), 4,365,702 (granted Dec. 28, 1982 to Tolasch et al.) and 4,507,040 (granted Mar. 26, 1985 to Baese et al.).

OBJECTS OF THE INVENTION

An object of the invention is to provide an apparatus which can treat the articles of the mass flows gently at as well as ahead and downstream of the locus of merger.

Another object of the invention is to provide an apparatus which ensures that the orientation of the articles at the locus of merger remains unchanged.

A further object of the invention is to provide an apparatus which can automatically regulate the merger of rod-shaped articles in dependency on the rate of delivery of articles to and/or the rate of removal of articles from the region of merger.

An additional object of the invention is to provide the apparatus with novel and improved means for regulating the merger of several mass flows of rod-shaped articles in such a way that the rate of delivery of articles to and/or the rate of removal of articles from the region of merger can fluctuate within a wide range without affecting the integrity of the articles and/or the orientation of articles which advance toward, through and beyond the region of merger.

Still another object of the invention is to provide a simple, compact and inexpensive apparatus which can be used in existing production lines as a superior substitute for presently known apparatus which serve to merge mass flows of rod-shaped articles.

SUMMARY OF THE INVENTION

The invention is embodied in an apparatus for merging first and second mass flows or streams of parallel rod-shaped articles of the tobacco processing industry which are transported sideways, i.e., at least substantially at right angles to their longitudinal axes. The improved apparatus comprises a first article supplying conveyor which defines an elongated first path and has means (e.g., endless belts) for advancing the first mass flow in a first direction, and a second article supplying conveyor defining an elongated second path which extends at an acute angle to and merges into the first path at a junction zone. The second conveyor has means for advancing the second mass flow in a second direction toward and into the junction zone, and the apparatus further comprises an article removing conveyor having means for transporting the merged first and second mass flows away from the junction zone, and means for regulating the flow of articles at the junction zone. The regulating means comprises a gate which is disposed at the junction zone and includes a first section and at least one second section. The gate is movable (by the articles, by hand or motorically by remote control) between a first position in which the first section prevents entry of one of the first and second mass flows into the junction zone and the at least one second section guides the other of the first and second mass flows at the junction zone, and a second position in which the one mass flow is free to enter the junction zone.

The gate can include or constitute a flap and is preferably pivotable between the first and second positions.

The first section of the gate can include or constitute a blocking, arresting or intercepting surface which extends substantially radially of the pivot axis of the gate a distance which approximates or matches the height of the path for the one mass flow. The at least one second section of such gate can include or constitute a convex or substantially convex guide surface which is adjacent the blocking surface of the first section.

The apparatus can be provided with a spring or with any other suitable means for biasing the gate to one of its positions, particularly to the first position.

The path for the one mass flow can be a substantially horizontal path, and the path for the other mass flow can merge into the substantially horizontal path from below.

The pivotable gate can rest on the top surface of the mass flow in the substantially horizontal path under the action of gravity.

The pivot axis for the gate is preferably located at a level above the path for the one mass flow at the junction zone.

The apparatus can further comprise a reservoir or buffer which is adjacent the junction zone, and a partition which is yieldably installed between the junction zone and the reservoir to permit entry of articles into the reservoir when the rate of delivery of articles to the junction zone by at least one of the first and second supplying conveyors exceeds the rate of removal of articles from the junction zone by the removing conveyor. The partition can constitute a pivotable lever-shaped sensor which rides on the top layer of articles in the junction zone or immediately or closely downstream of the junction zone.

In accordance with a modification, the gate can comprise the aforementioned at least one second section at one end of the first section and another second section at the other end of the first section. The removing conveyor defines a third path having a predetermined height and the at least one second section has a guide surface which directs the articles of the other mass flow into the third path the full height of the third path in the first position of the gate. Such apparatus preferably further comprises a mobile or stationary wall which is adjacent the junction zone to define with the other second section a first-in last-out reservoir or buffer in the second position of the gate so that the reservoir can temporarily store those rod-shaped articles which cannot be transported away along the third path, i.e., by the removing conveyor. The path for the other mass flow in such apparatus can be a substantially horizontal path and the path for the one mass flow is then preferably located above the substantially horizontal path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
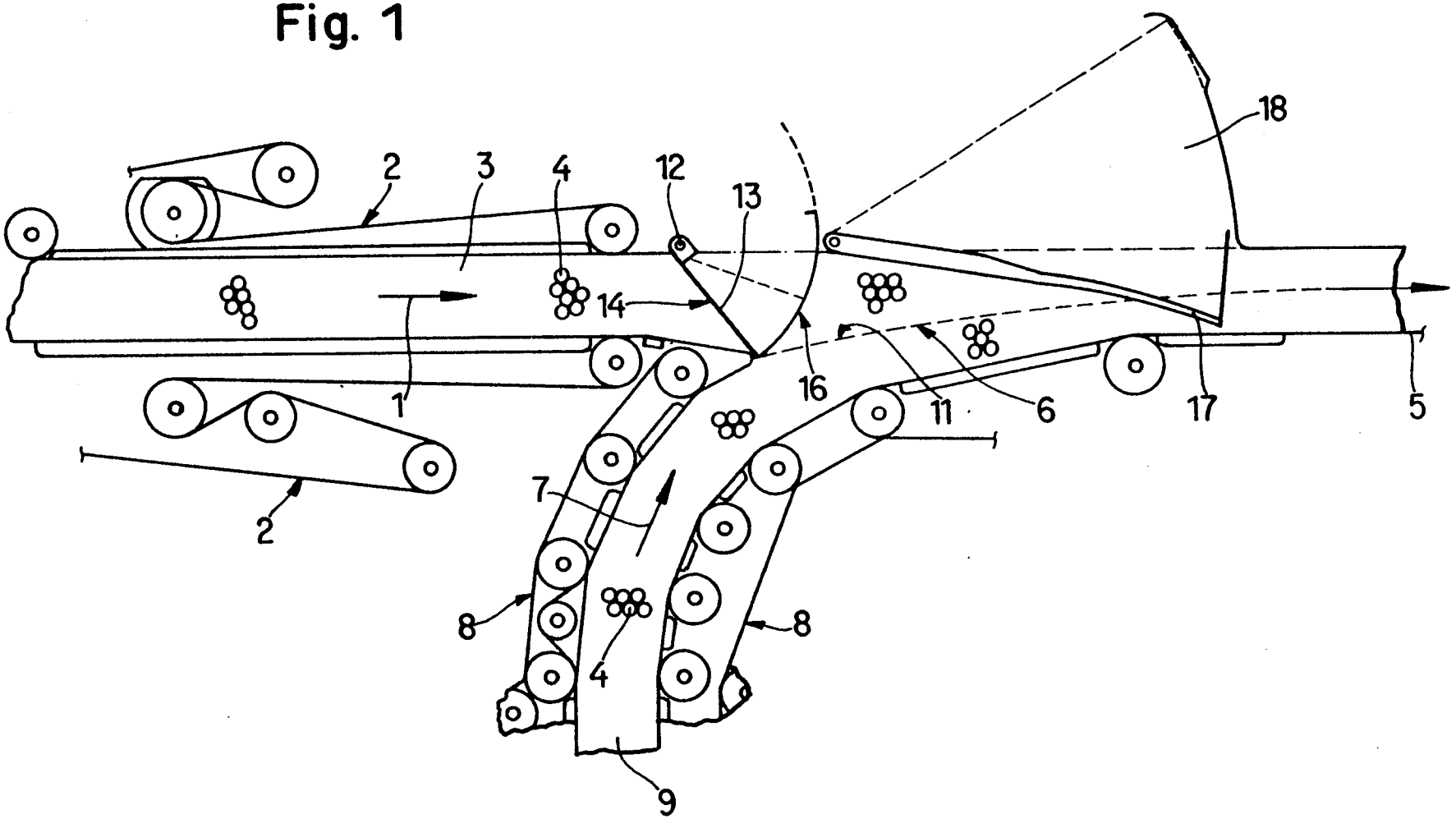
FIG. 1 is a schematic longitudinal vertical sectional view of an apparatus which embodies one form of the invention and is designed to merge an ascending mass flow of rod-shaped articles into a horizontal mass flow.

Referring first to FIG. 1, there is shown an apparatus which comprises a first article supplying conveyor having several driven endless belts 2 and serving to advance a first mass flow 3 of parallel rod-shaped articles 4 (e.g., plain or filter cigarettes) along a substantially horizontal path wherein the articles 4 of the mass flow 3 advance in the direction of arrow 1. The apparatus further comprises a second article supplying conveyor having several driven endless belts 8 and defining an upwardly sloping second path for a second mass flow 9 of articles 4 which are caused to advance in the direction of arrow 7. The two paths make an acute angle and the path for the mass flow 9 merges from below into the path for the mass flow 3 at a junction zone or merger zone 6 immediately upstream of an article removing third conveyor having one or more driven endless belts 5 and serving to advance the merged mass flows 3 and 9 in the direction of arrow 10.

The means for regulating the advancement of articles 4 at the junction zone 6 includes a gate or flap 13 pivotable about the horizontal axis of a shaft 12 which is mounted in the frame (not shown) of the merging apparatus. The gate 13 normally rests by gravity on the upper side of the mass flow 3 which advances through the junction zone 6 and onto the article removing conveyor including the belt or belts 5. The articles 4 are parallel to each other and are moved sideways, i.e., the longitudinal axes of such articles are normal to the plane of FIG. 1 and to the directions (arrows 1, 7 and 10) of advancement of the mass flows 3 and 9.

The line 11 indicates the region where the advancing mass flows 3 and 9 merge gently without any or without appreciable turbulence so that the orientation of the articles 4 remains unchanged and the resulting merged mass flow 3+9 is devoid of cavities.

The purpose of the gate 13 is to regulate the mass flow 3, namely to interrupt, to restrict or not to impede the advancement of articles 4 which form the mass flow 3 into and through the junction zone 6 toward and onto the belt or belts 5 of the article removing conveyor. To this end, the gate 13 comprises a first section 14 having a blocking surface which extends substantially radially of the axis of the shaft 12, and a second section 16 having a convexly curved surface which serves to guide the articles 4 of the mass flow 9 on their way through the junction zone 6 while the gate 13 is maintained (by hand, by a motor or otherwise) in the illustrated blocking position. At such time, the articles 4 of the mass flow 3 are prevented from entering the junction zone 6. The convexly curved surface of the second section 16 is effective the full height h of the path for the mass flow 3 and is immediately adjacent to and located downstream of the section 14, as seen in the direction of arrow 1. When the gate 13 is to permit entry of the mass flow 3 into the junction zone 6, the radially extending surface of the first section 14 simply rides on top of the uppermost layer of articles 4 forming the mass flow 3 while such articles advance toward the article removing conveyor including the belt or belts 5.

When the articles 4 tend to pile up at the junction zone 6, they pivot an elongated partition 17 which is located between the junction zone 6 and the lower end of a first-in last-out reservoir or buffer 18. The partition 17 is pivotably mounted in the frame of the apparatus, as at 19, so that it can turn about an axis which is parallel to that of the shaft 12 for the gate 13. The partition 17 can be said to constitute a lever-shaped sensor which monitors the height of the merged mass flow 3+9 and automatically enters the lower end of the reservoir 18 to rest on the supply of parallel rod-shaped articles 4 which gather in the reservoir when the rate of admission of articles by the two supplying conveyors exceeds the ability of the removing conveyor to transport articles to the next processing station. For example, the mass flow 3 can issue from a first cigarette making machine, the mass flow 9 can issue from a second cigarette making machine, and the conveyor including the belt or belts 5 can serve to transport the merged mass flows 3 and 9 to a processing machine, e.g., a packing machine or a filter tipping machine.

It will be noted that the shaft 12 for the gate 13 is located at a level above the horizontal path for the mass flow 3, i.e., for that mass flow which is regulated by the gate.

The convexly curved surface of the section 16 of the gate 13 can properly guide articles 4 of the mass flow 3 regardless of the momentary height of the mass flow in the path which is defined by the belts 2 of the first article supplying conveyor. This is due to the fact that the gate 13 rests on the adjacent articles 4 only by gravity and, therefore, can control the advancement of articles when the height of the mass flow 3 matches the maximum height h of the path for this mass flow or is a mere fraction of the height h. The surface of the section 16 stabilizes the adjacent articles 4 of the mass flow 3 and ensures that such mass flow can bypass the gate 13 regardless of its momentary height.

Figure 2:
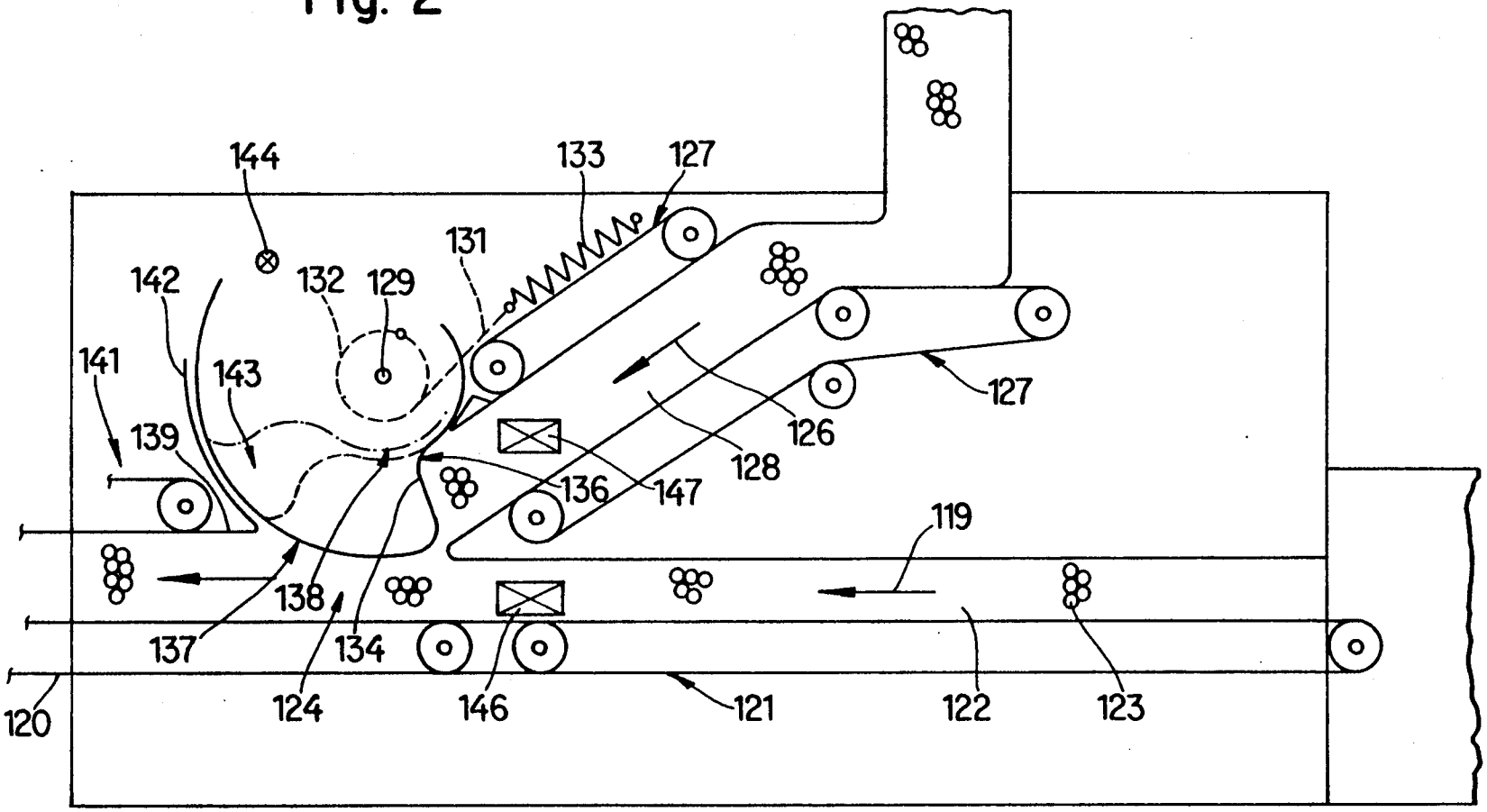
FIG. 2 is a similar schematic longitudinal vertical sectional view of a second apparatus wherein a descending mass flow is caused to merge into a horizontal mass flow of rod-shaped articles.

The apparatus which is shown in FIG. 2 comprises a first article supplying conveyor including one or more driven endless belts 121 which define a substantially horizontal path for a first mass flow 122 of rod-shaped articles 123 advancing in the direction of arrow 119 toward, through and beyond a junction or merger zone 124. A second article supplying conveyor includes several driven endless belts 127 which define a downwardly sloping second path for a second mass flow 128 of rod-shaped articles 123. The direction of advancement of articles 123 which form the mass flow 128 is indicated by arrow 126, and the second path makes with the first path an acute angle of less than 45 degrees. The mass flows 122 and 128 merge at the junction zone 124, and the resulting mass flow is advanced by a removing conveyor 141 having one or more driven endless belts 120. The direction of advancement of the merged mass flows 122 and 128 beyond the junction zone 124 is indicated by arrow 110. The articles 123 are parallel to each other and are moved sideways, i.e., at right angles to their longitudinal axes and to the directions which are indicated by arrows 119, 126 and 110. The height of the path which is defined by the belt or belts 120 of the removing conveyor 141 is indicated at h'.

The gate 134 of FIG. 2 can pivot about the horizontal axis of a shaft 129 which is located at a level above the mass flow 128 at the junction zone 124 and is surrounded by a cylinder 132. The latter is rigid with the gate 134 and is biased by a stressed coil spring 133 (through the medium of a chain, belt or rope 131) so that it tends to turn the gate in a clockwise direction toward the first position (shown by solid lines) in which the radially extending blocking surface of a first section 136 of the gate intercepts the articles 123 of the mass flow 128. At the same time, the convexly curved second section 137 of the gate 134 guides the articles 123 of the advancing mass flow 122 on their way through and beyond the junction zone 124 the full height h' of the path which is defined by the removing conveyor 141. The upper level of the merged mass flows 122 and 128 which enter the conveyor 141 (or of the mass flow 122 when the gate 134 assumes the position which is shown in FIG. 2 by solid lines) is indicated at 139.

The gate 134 comprises a further section 138 which can cooperate with the concave surface of an adjacent stationary wall 142 and with the section 136 to define a first-in last-out reservoir or buffer 143 for the surplus of rod-shaped articles 123 which cannot enter the removing conveyor 141 when the gate is caused to assume its open position [in which the radially extending blocking surface of the section 136 is ineffective). The sections 137, 138 of the gate 134 are located at opposite ends of the section 136, and the surfaces of the sections 137, 138 extend in opposite directions. The section 138 has a convexly curved surface which guides the mass flow 129 in the open position of the gate 134.

FIG. 2 further shows an initiator 144 which can constitute an optoelectronic sensor in or at the reservoir 143 to transmit a signal when the reservoir is filled, and such signal is transmitted to a standard control circuit which arrests the belts 127 of the second article supplying conveyor. The fully open position of the gate 134 is indicated by phantom lines.

The reference characters 146 and 147 denote photoelectronic or other suitable detectors which serve to monitor and regulate the speed of the endless belts 122 and 127, respectively, in a manner not forming part of the present invention.

The three-section gate 134 of FIG. 2 can regulate the advancement of articles 123 through the junction zone 124 in a particularly satisfactory manner. When the gate 134 rides on the topmost layer of articles 123 in the mass flow 128, i.e., when the gate 134 is held in the open position, it is stressed by the spring 133 and can automatically reassume the position which is shown in FIG. 2 by solid lines when the pressure upon the radially extending surface of its section 136 is reduced. The means for positively moving the gate 134 against the opposition of the spring 133 is not shown in the drawing. Such moving means receives signals from the initiator 141 or from the machine which accepts articles 123 from the removing conveyor 141.

The gate 13 and/or 134 can be designed to regulate the flow of articles in both mass flows, and each of these gates can be moved to one or more intermediate positions to act not unlike a flow restrictor for one or both mass flows at the function zone.

An important advantage of the improved apparatus is that the gates 13 and 134 ensure gentle treatment of articles 4 or 123 during advancement through the junction zone 6 or 124. This reduces the number of rejects in the processing machine or machines which receive articles from the removing conveyor. Moreover, the gates prevent the development of gaps or cavities in the mass flow or mass flows which advance beyond the respective junction zones and, therefore, the orientation of articles 4 or 123 remains unchanged. This also ensures gentle treatment of the articles and entails a substantial reduction of the number of rejects in the machine or machines which receive articles from the improved apparatus. The mass flows 3, 9 or 122, 128 merge gently without any, or without appreciable, movement of articles in one of the mass flows relative to the articles in the other mass flow.

Another advantage of the improved apparatus is that the reservoir 18 or 143 can automatically accept the surplus of articles 4 or 123 when the rate of removal of articles from the junction zone 6 or 124 cannot match the rate of delivery of articles to the junction zone. The shape of the reservoirs 18 and 143 is such that their capacity exactly matches the requirements, i.e., that their ability to accept articles conforms to the momentary requirements. This, in turn, ensures that the articles which have entered the reservoir 18 or 143 cannot lie askew and are less likely to be deformed and/or otherwise damaged than if they were given freedom of movement relative to each other while forming part of a batch of articles in the reservoir 18 or 143. One or both article supplying conveyors are arrested or decelerated in automatic response to filling of the reservoirs, i.e., when the reservoirs cannot accept additional articles. This prevents excessive compression of articles in the reservoirs.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for merging first and second mass flows of parallel rod-shaped articles of the tobacco processing industry which are transported sideways, comprising a first article supplying conveyor defining an elongated first path and having means for advancing the first mass flow in a first direction; a second article supplying conveyor defining an elongated second path which extends at an acute angle to and merges into said first path at a junction zone, and second conveyor having means for advancing the second mass flow in a second direction toward and into said junction zone; an article removing conveyor having means for transporting the merged mass flows away from said junction zone; and means for regulating the advancement of articles at said junction zone, comprising a gate disposed at said junction zone and including a first section and at least one second section, said gate being movable between a first position in which said first section prevents entry of one of said first and second mass flows into said junction zone and said at least one second section guides the other of said first and second mass flows at said junction zone, and a second position in which the one mass flow is free to enter said junction zone, the path for said one mass flow being a substantially horizontal path and the path for said other mass flow merging into said substantially horizontal path from below.

2. The apparatus of claim 1, wherein said gate includes a flap which is pivotable between said first and second positions.

3. The apparatus of claim 1, wherein the path for said one mass flow has a predetermined height and said gate is pivotable between said positions about a predetermined axis, said first section having a blocking surface extending substantially radially of said axis a distance which approximates or equals said predetermined height.

4. The apparatus of claim 3, wherein said at least one second section has a convex guide surface adjacent said blocking surface.

5. The apparatus of claim 1, wherein said second section has a convex guide surface for the articles of said other mass flow.

6. The apparatus of claim 1, wherein said gate is pivotable between said first and second positions and, when in said second position, rests by gravity on the one mass flow.

7. The apparatus of claim 1, wherein said gate is pivotable about an axis which is located at a level above the path for said one mass flow at said junction zone.

8. Apparatus for merging first and second mass flows of parallel rod-shaped articles of the tobacco processing industry which are transported sideways, comprising a first article supplying conveyor defining an elongated first path and having means for advancing the first mass flow in a first direction; a second article supplying conveyor defining an elongated second path which extends at an acute angle to and merges into said first path at a junction zone, said second conveyor having means for advancing the second mass flow in a second direction toward and into said junction zone; an article removing conveyor having means for transporting the merged mass flows away from said junction zone; means for regulating the advancement of articles at said junction zone, comprising a gate disposed at said junction zone and including a first section and at least one second section, said gate being movable between a first position in which said first section prevents entry of one of said first and second mass flows into said junction zone and said at least one second section guides the other of said first and second mass flows at said junction zone, and a second position in which said one mass flow is free to enter said junction zone; a reservoir adjacent said junction zone; and a partition yieldably installed between said junction zone and said reservoir to permit entry of articles into said reservoir when the rate of delivery of articles to said junction zone by at least one of said first and second conveyors exceeds the rate of removal of articles by said removing conveyor.

9. The apparatus of claim 8, wherein said gate includes a flap which is pivotable between said first and second positions.

10. The apparatus of claim 8, wherein the path for said one mass flow has a predetermined height and said gate is pivotable between said positions about a predetermined axis, said first section having a blocking surface extending substantially radially of said axis a distance which approximates or equals said predetermined height.

11. The apparatus of claim 10, wherein said at least one second section has a convex guide surface adjacent said blocking surface.

12. The apparatus of claim 8, wherein said second section has a convex guide surface for the articles of said other mass flow.

13. The apparatus of claim 8, wherein the path for said one mass flow is a substantially horizontal path and said path for the other mass flow merges into said substantially horizontal path from below.

14. The apparatus of claim 13, wherein said gate is pivotable between said first and second positions and, when in said second position, rests by gravity on said one mass flow.

15. The apparatus of claim 8, wherein said gate is pivotable about an axis which is located at a level above the path for said one mass flow at said junction zone.

* * * * *